United States Patent [19]

Newman

[11] 4,226,249

[45] Oct. 7, 1980

[54] CIGARETTE FIRE EXTINGUISHER

[76] Inventor: Marion A. Newman, 4812 Gina, Del City, Okla. 73115

[21] Appl. No.: 34,087

[22] Filed: Apr. 27, 1979

Related U.S. Application Data

[63] Continuation-in-part of Ser. No. 850,585, Nov., 1977, abandoned.

[51] Int. Cl.[3] ..... A24D 1/10

[52] U.S. Cl. ..... 131/4A

[58] Field of Search ..... 131/4 A, 10.1, 12, 13, 131/17 R

[56] References Cited

U.S. PATENT DOCUMENTS

| | | | |
|---|---|---|---|
| 1,726,737 | 9/1929 | Harris | 131/4 A |
| 2,863,461 | 12/1958 | Frost, Jr. | 131/10.1 |
| 3,258,015 | 6/1966 | Ellis et al. | 131/10.1 |
| 3,985,143 | 10/1976 | Lappin, Jr. | 131/4 A |

FOREIGN PATENT DOCUMENTS

| | | | |
|---|---|---|---|
| 1919599 | 10/1969 | Fed. Rep. of Germany | 131/9 |
| 232819 | 7/1925 | United Kingdom | 131/4 A |
| 835923 | 5/1960 | United Kingdom | 131/4 A |

*Primary Examiner*—Stephen C. Pellegrino
*Attorney, Agent, or Firm*—Robert K. Rhea

[57] ABSTRACT

A cigarette fire extinguishing burnable insert axially disposed within a cigarette comprises an elongated tube connected with a fluid filled reservoir adjacent the filter end of the cigarette. A frangible wall separates the reservoir from the elongated tube. Manually collapsing the cigarette at the reservoir end ruptures the frangible wall and exhausts the liquid through the tube to quench the cigarette fire cone.

3 Claims, 5 Drawing Figures

CIGARETTE FIRE EXTINGUISHER

CROSS REFERENCE TO RELATED APPLICATION

This application is a continuation-in-part of an application filed by me in the United States Patent and Trademark Office on Nov. 11, 1977, under Ser. No. 850,585, for SMOKING ARTICLE INSERT now abandoned.

BACKGROUND OF THE INVENTION

1. Field of the invention.

The present invention relates to cigarettes and more particularly to a liquid filled insert surrounded by the tobacco of a cigarette for extinguishing the cigarette fire cone As is well known, carelessly discarding burning cigarettes many times results in fire destroying homes, forests, grasslands and other property as well as human and wildlife. To prevent such fires the cigarette must be extinguished before it leaves the smoker's hand. This invention provides an insert for cigarettes which will immediately extinguish the fire of a burning cigarette, within three seconds, by the smokers's action of squeezing the cigarette adjacent the filter end prior to discarding it in any manner. This extinguishing action also eliminates the odor of a smoldering cigarette left in ashtrays and further will extinguish the cigarette fire cone in the event it is discarded without the smoker ejecting the fire extinguishing liquid.

2. Description of the prior art

Prior patents, such as U.S. Pat. No. 1,726,737 and U.S. Pat. No. 2,863,461, generally disclose a liquid containing bulb-like member which is inserted into the tobacco of a cigarette, or the like, adjacent the mouth end for the purposes of rupturing the bulb member to extinguish the fire of the cigarette, as in U.S. Pat. No. 1,726,737, or for moisturizing the tobacco, as in U.S. Pat. No. 2,863,461, to form a smoke filtering zone while the article is being smoked.

Other Patents, such as U.S. Pat. Nos. 3,756,249 and 3,863,644, disclose disposing at least one elongated open end tube axially within a smokable article between the ends thereof for admitting air to the smoke stream while the article is being smoked.

This invention is distinctive over these patents and the disclosure of my copending application by axially disposing a generally cylindrical reservoir containing a quantity of liquid, such as water, within the cigarette adjacent the filter or mouth end, axially connected with an elongated small diameter tube projecting through the cigarette to its other end. The wall portion of the reservoir, joined to the elongated tube, is relatively thin when compared to the thickness of the remaining reservoir wall so that this thin wall portion is ruptured by pressure manually applied to the portion of the cigarette surrounding the reservoir for extinguishing the fire prior to discarding the cigarette butt.

SUMMARY OF THE INVENTION

An elongated burnable small diameter tube, axially joined at one end with a burnable diametrically enlarged liquid filled reservoir, is longitudinally disposed within the tobacco of a cigarette at the time of manufacture with the reservoir disposed adjacent the mouth end of the cigarette. A thin portion of the reservoir wall or a separate disk-like thin wall member forms a frangible partition between the reservoir and the tube at their juncture. The cigarette fire burns the tube with the tobacco until such time that the cigarette is to be discarded when the smoker manually applies opposing finger and thumb pressure to the cigarette in a crushing fashion which ruptures the thin wall partition and exhausts reservoir fluid to the burning end portion of the cigarette. In the event the smoker fails to collapse the reservoir, the fire progressively burning the tobacco burns the frangible wall and a portion of the reservoir which releases the liquid therein and extinguishes the fire.

The principal object of this invention is to provide an insert for a cigarette including a liquid filled reservoir for extinguishing the cigarette fire upon rupture of a frangible wall.

DESCRIPTION OF THE PREFERRED EMBODIMENT

Figure 1:
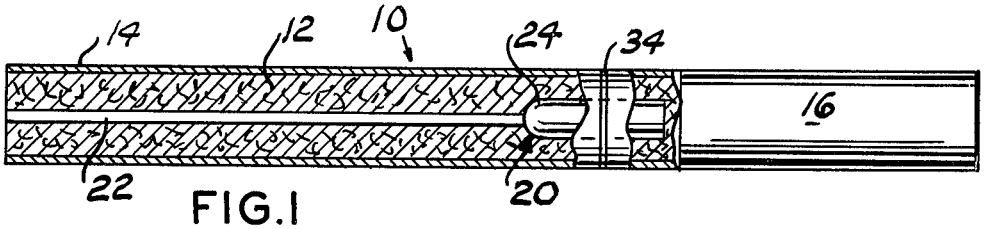
FIG. 1 is a longitudinal cross sectional view, partially in elevation, illustrating the cigarette insert in place.
Figure 2:
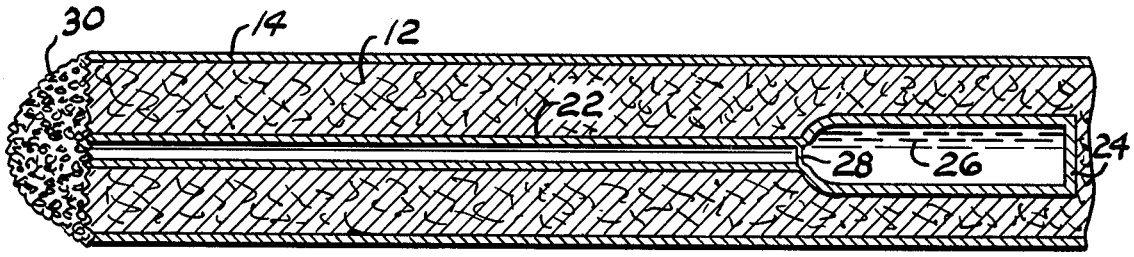
FIG. 2 is a fragmentary longitudinal sectional view of the cigarette and insert.

Like characters of reference designate like parts in those figures of the drawings in which they occur.

In the drawings:

The reference numeral 10 indicates a conventional cigarette comprisig a rod or cylinder of tobacco 12 surrounded by a wrapper 14 and coaxially connected with a filter 16. The numeral 20 indicates a cigarette insert comprising an elongated tube 22, axially connected at one end with one end of a generally cylindrical enlarged portion, to form a reservoir 24 filled with a noncombustable liquid, such as water 26.

Figure 3:
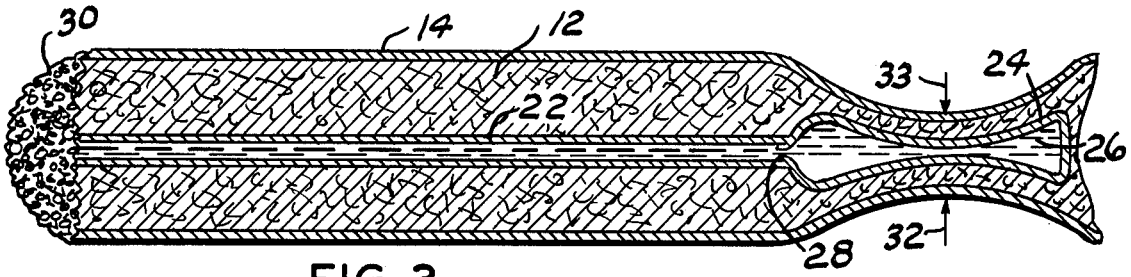
FIG. 3 is a view similar to FIG. 2 illustrating the reservoir collapsed and frangible wall ruptured position and fire extinguishing action.

The end wall of the reservoir 24, at its juncture with the tube 22, is relatively thin when compared with the thickness of its remaining wall to form a weakened partition wall or frangible section 28 surrounded by the adjacent end of the tube 22. The purpose of the frangible wall section 28 is to release the liquid 26 through the tube 22 to extinguish the fire cone, indicated at 30, in response to the smoker squeezing the cigarette in the direction of the arrows 32 and 33 (FIG. 3) between his thumb and forefinger at a position adjacent the filter 16 which compresses the tobacco and wall of the reservoir 24 inwardly to rupture the wall portion 28.

The tube 22 is characterized by a thin wall and may be formed from a variety of materials acceptable for smoking, such as glassine paper or a strip of cigarette tobacco paper coated to be liquid proof and rolled and joined to form a tube by a longitudinal seam sealing composition, such as disclosed by U.S. Pat. No. 3,863,644. The reservoir 24 is formed in a similar manner integral with or joined to the tube, as presently described.

The diameter of the tube is preferably not more than 2 mm and its length is 4 to $4\frac{1}{2}$ cm according to the length of the cigarette. The diameter of the reservoir is preferably not greater than 3½ mm to minimize hampering the draw of the cigarette and its length 1 cm to 1½ cm. The combined length of the tube 22 and reservoir 24 is preferably slightly less than the length of the tobacco rod 12 whether used with a filter or nonfilter cigarette.

The insert 20 is preferably coaxially installed within the cigarette 10 at the time of manufacture with the reservoir disposed adjacent the mouth end or filter 16. The cigarette wrapper 14 is preferably printed or scored with a line or colored band 34 circumferentially surrounding the cigarette medially the length of the reservoir 24, as an indication of the desired position for the smoker to apply a smashing or crushing action on the cigarette prior to discarding it.

Figure 4:
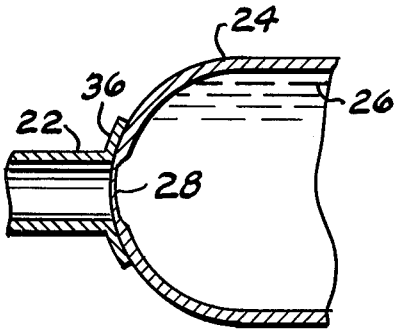
FIG. 4 is a fragmentary vertical cross sectional view, to an enlarged scale, illustrating the frangible wall separating the reservoir liquid from the elongated tube; and, FIG. 5 is a view similar to FIG. 4 illustrating a disk forming the frangible wall.

FIG. 4 illustrates one manner of joining the tube 22 to the reservoir 24 around the position of the frangible wall area 28 in which the end of the tube is provided with an outstanding annular flange 36 which is sealed to the outer end wall surface of the reservoir.

Figure 5:
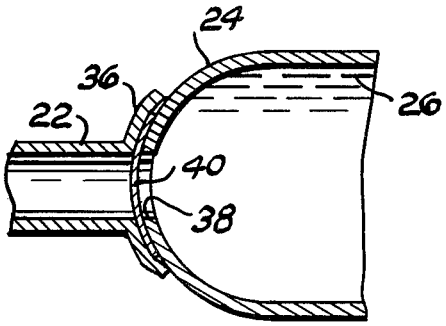

FIG. 5 illustrates another manner of joining the tube 22 to the reservoir 24 in which the reservoir is provided with an aperture 38 in its end wall adjacent the tube 22 with the diameter of the aperture 38 not being greater than the inside diameter of the tube 22. In this embodiment, a frangible partition formed by a thin disk 40 is interposed between the tube annular flange 36 and adjacent end wall surface of the reservoir 24 and sealed therebetween thus closing the reservoir aperture 38 until such time as the disk 40 is ruptured by the smoker squeezing the cigarette.

OPERATION

In operation, the cigarette fire cone 30 is usually extinguished by the smoker on the partially smoked cigarette or when smoked to the usual butt length of the particular smoker and when discarded in an ashtray or out of doors by squeezing the cigarette between his thumb and forefinger at the position of the band 34 to collapse the reservoir wall 24. This ejects the major quantity of the liquid 26 through the tube 22 which extinguishes the fire cone.

In the event that the smoker fails to collapse the reservoir, when the fire cone reaches the junction of the tube and reservoir the frangible wall 28 is burned which releases the liquid and extinguishes the fire cone.

Obviously the invention is susceptible to changes or alterations without defeating its practicability. Therefore, I do not wish to be confined to the preferred embodiment shown in the drawings and described herein.

I claim:

1. In an elongated smoking article which includes a cylinder of tobacco and cylindrical wrapping of combustible material closely surrounding said tobacco cylinder and being longitudinally coextensive therewith, said smoking article having opposing ends forming, respectively, a mouth end and a fire end, the improvement comprising:

an elongated open end tube formed from combustible material axially disposed within said tobacco cylinder and extending from a point adjacent the mouth end to the fire end;

an elongated liquid containing reservoir within said tobacco cylinder and axially joined to the mouth end of said tube; and, frangible wall means at the juncture of said tube and reservoir normally maintaining the liquid in said reservoir.

2. The combination according to claim 1 in which said reservoir is characterized by a thin wall portion forming the frangible wall means.

3. The combination according to claim 1 in which said reservoir is provided with an aperture in its end wall surrounded by the adjacent end portion of said tube and said frangible wall means comprises:

a frangible disk interposed between said reservoir and the adjacent end portion of said tube for normally closing the reservoir aperture.

* * * * *